US012575622B2

(12) United States Patent
Kim

(10) Patent No.: US 12,575,622 B2
(45) Date of Patent: Mar. 17, 2026

(54) FLEXIBLE FACE MASK HAVING SIDES THAT ADHERE CLOSELY TO WEARER'S CHEEKS

(71) Applicant: Wellness CO., Ltd, Goyang-si (KR)

(72) Inventor: Je Dam Kim, Goyang-si (KR)

(73) Assignee: Wellness CO., Ltd, Goyang-si (KR)

( * ) Notice: Subject to any disclaimer, the term of this patent is extended or adjusted under 35 U.S.C. 154(b) by 0 days.

(21) Appl. No.: 19/215,700

(22) Filed: May 22, 2025

(65) Prior Publication Data

US 2025/0366547 A1 Dec. 4, 2025

(30) Foreign Application Priority Data

May 28, 2024 (KR) ..... 10-2024-0069030

(51) Int. Cl.
*A41D 13/11* (2006.01)

(52) U.S. Cl.
CPC ..... *A41D 13/1169* (2013.01); *A41D 13/1115* (2013.01)

(58) Field of Classification Search
CPC . A41D 13/11; A41D 13/1107; A41D 13/1115; A41D 13/1161; A41D 13/1169; A41D 13/1176; A62B 23/025
See application file for complete search history.

(56) References Cited

U.S. PATENT DOCUMENTS

| | | | | |
|---|---|---|---|---|
| 2021/0022418 | A1* | 1/2021 | Furuya | A41D 13/1115 |
| 2022/0151319 | A1* | 5/2022 | Wingard | A41D 13/1169 |
| 2022/0211125 | A1* | 7/2022 | Li | A41D 13/1115 |
| 2023/0404188 | A1* | 12/2023 | Kim | A62B 23/025 |

FOREIGN PATENT DOCUMENTS

| | | | | |
|---|---|---|---|---|
| KR | 1020180050678 | A | 5/2018 | |
| KR | 102292047 | B1 | 8/2021 | |
| KR | 20220001550 | U | 6/2022 | |
| KR | 1020220126605 | A | 9/2022 | |
| KR | 20220163643 | A * | 12/2022 | A62B 18/025 |

OTHER PUBLICATIONS

1st Office Action for KR10-2024-0069030 mailed on Aug. 9, 2024.
2nd Office Action for KR10-2024-0069030 mailed on Jan. 22, 2025.
Notice of Allowance for KR10-2024-0069030 mailed on Mar. 21, 2025.

* cited by examiner

*Primary Examiner* — Keri J Nelson
(74) *Attorney, Agent, or Firm* — Rivka Friedman

(57) ABSTRACT

Proposed is a flexible dental mask having sides that adhere closely to the wearer's cheeks, in which both sides of a rectangular mask body are bonded so that a predetermined length of a lower end of a pleated portion is not bonded, thus forming a non-bonded portion, and only the remaining part excluding the non-bonded portion is bonded, so the non-bonded portion is folded to flexibly cope with shape deformation when the mask is worn, enabling the both sides of the mask body to closely adhere to the wearer's cheeks when the mask is worn.

3 Claims, 5 Drawing Sheets

FLEXIBLE FACE MASK HAVING SIDES THAT ADHERE CLOSELY TO WEARER'S CHEEKS

CROSS REFERENCE TO RELATED APPLICATION

The present application claims priority to Korean Patent Application No. 10-2024-0069030, filed May 28, 2024, the entire contents of which is incorporated herein for all purposes by this reference.

BACKGROUND OF THE INVENTION

Field of the Invention

The present disclosure relates generally to a dental mask. More particularly, the present disclosure relates to a flexible dental mask having sides that adhere closely to the wearer's cheeks, the mask being capable of enabling the sides of the mask to completely closely adhere to the wearer's cheeks by solving a poor adhesion problem of a conventional dental mask in which sides of a mask body come off from the wearer's cheeks without closely adhering to the cheeks when the mask is worn.

Description of the Related Art

In general, masks are used to cover the nose and mouth to block external cold air and prevent the inhalation and spread of various viruses, dust, etc. Depending on use purposes, various types of masks are commercially available, including a winter mask made using non-woven fabrics, etc., an industrial mask that combines various filters to be able to even fine dust, and a dustproof mask. Since the World Health Organization (WHO) declared a global pandemic due to the spread of the corona virus disease following SARS and MERS, the interest in masks has increased and wearing masks has become a daily routine, so masks have become an essential item when people go out.

Meanwhile, among medical masks, a 3D mask is composed of three pieces with separate supports attached to upper and lower parts of a mask body. The support attached to the upper part of the dome-shaped mask body is held on the bridge of the nose so that the mask does not slip down, and both sides of the mask body adhere closely to the wearer's cheeks. In the case of a 2D mask composed of two pieces, a mask-shaped central upper part is held on the bridge of the nose and both sides of the mask closely adhere to the wearer's cheeks, so the mask can block most viruses and foreign substances from penetrating when worn.

However, a dental mask, including a surgical mask, has a rectangular mask body, multiple pleated portions are formed on the mask body, and both sides of the mask body are entirely bonded, so when the mask is worn, the pleated portions are pulled up and down to expand, and the central part of the mask body is increased in length to form a dome shape. However, since the both sides of the mask body are entirely bonded, they do not have elasticity or flexibility. Further, they cannot naturally bend into a round shape and become wrinkled without flexibly coping with shape deformation. Due thereto, the both sides of the mask come off from the wearer's cheeks without closely adhering to the cheeks when the mask is worn. Therefore, even while being worn, the mask may fail to completely block the penetration of various viruses or foreign substances, which is a very serious and fatal problem for use as a health quarantine mask (see FIG. 5).

While 3D masks and 2D masks have been approved and sold as quarantine masks, due to the critical problem in their quarantine function in which the both sides of the mask cannot closely adhere to the wearer's cheeks, dental masks have not been sold for quarantine purposes but been sold as industrial products that are unrelated to quarantine.

Regarding dental masks, there are disclosed many technologies and products in Korean Patent No. 10-2506590, entitled "Functional Mask", Korean Patent No. 10-2528194, entitled "Wireless Mask", Korean Patent Application Publication No. 10-2022-0126605 "Face Close-Up Mask", and Korean Patent Application Publication No. 10-2022-0037194 "Mask". However, these still cannot overcome the problem of lack of adhesion posed by the conventional dental mask in which the both sides of the mask body come off from the wearer's cheeks without closely adhering to the cheeks when the mask is worn.

The foregoing is intended merely to aid in the understanding of the background of the present disclosure, and is not intended to mean that the present disclosure falls within the purview of the related art that is already known to those skilled in the art.

SUMMARY OF THE INVENTION

Accordingly, the present disclosure has been made keeping in mind the above problems occurring in the related art, and an objective of the present disclosure is to provide a flexible dental mask having sides that adhere closely to the wearer's cheeks, in which both sides of a rectangular mask body are bonded so that a predetermined length of a lower end of a pleated portion is not bonded, thus forming a non-bonded portion, and only the remaining part excluding the non-bonded portion is bonded, so the non-bonded portion is folded to flexibly cope with shape deformation when the mask is worn, enabling the both sides of the mask body to closely adhere to the wearer's cheeks when the mask is worn.

Another objective of the present disclosure is to provide a flexible dental mask having sides that adhere closely to the wearer's cheeks, in which a nose bridge adhesive pad is attached to an inner side of a mask body, so the mask does not slip down even when the wearer talks or yawns with the mask on and prevents glasses from fogging up.

In order to achieve the above objectives, according to one aspect of the present disclosure, there is provided a flexible dental mask having sides that adhere closely to the wearer's cheeks, the flexible dental mask including: a rectangular mask body having multiple pleated portions folded in two to four stages, wherein the pleated portions may be formed so that there is no non-overlapping area between the pleated portions, and both sides of the mask body may be bonded so that a predetermined length of a lower end of each of the pleated portions is not bonded, thus forming a non-bonded portion, and the non-bonded portion is defined between bonded portions, so when the mask is worn and the sides of the mask are deformed from a straight shape into a round shape, the non-bonded portion may be inserted between and overlapped with the bonded portions, thereby coping with shape deformation of the sides of the mask and enabling the both sides of the mask body to closely adhere to the wearer's cheeks; and each of the bonded portions bonded to the both sides of the mask body may have a length two to three times a length of the non-bonded portion.

Preferably, a nose bridge adhesive pad having a vertical height that is about ½ to ⅓ of a vertical height of the mask body may be further attached to an upper end of a rear surface of the mask body. The nose bridge adhesive pad may be attached by boding an upper end and both sides thereof to the mask body, and the both sides of the nose bridge adhesive pad may be bonded to the mask body so that a predetermined length of a lower end of the nose bridge adhesion pad is not bonded, thus forming a non-bonded portion.

According to the flexible dental mask according to the present disclosure, the both sides of the rectangular mask body having the pleated portions folded in two to four stages are bonded so that a predetermined length of the lower end of each of the pleated portions is not bonded, thus forming the non-bonded portion, and only the remaining part excluding the non-bonded portion is bonded. With this configuration, when the mask is worn on and the both sides of the mask body are deformed from a straight shape into a round shape, the non-bonded portion between the bonded portions can be folded or overlapped with the bonded portions like a bellows (pleated box), thereby freely and flexibly coping with shape deformation. This ensures that the both sides of the mask body can completely closely adhere to the wearer's cheeks while forming a round shape when the mask is worn, thereby achieving significantly improved adhesion of the both sides of the dental mask.

Additionally, since the nose bridge adhesive pad is attached to the inner side of the mask body, the nose bridge adhesion pad is held to closely adhere to the bridge of the nose when the mask is worn. Therefore, even when the wearer talks or yawns with the mask on, the mask does not move out of the bridge of the nose and can be kept in a normally worn state without slipping down. Additionally, since the nose bridge adhesive pad closely adheres to the bridge of the nose and curved areas around the bridge of the nose to block gaps, it is possible to block viruses from penetrating through the gaps and prevent glasses from fogging up due to exhalation of the wearer talking or breathing with the mask on.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

Figure 1:
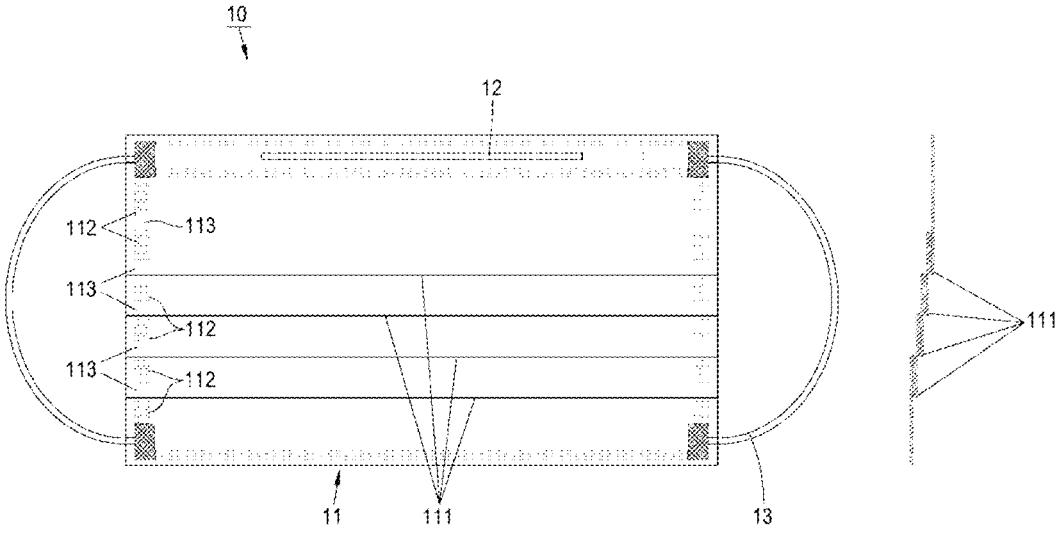
FIG. 1 is a view illustrating a front surface of a flexible dental mask according to the present disclosure.

The technical feature of a flexible dental mask according to the present disclosure is that both sides of a mask body are bonded so that a predetermined length of a lower end of a pleated portion is not bonded, thus forming a non-bonded portion, so the non-bonded portion can flexibly cope with shape deformation of the both sides when the mask is worn, thereby ensuring that the both sides of the mask body closely adhere to the wearer's cheeks when the mask is worn.

The flexible dental mask according to the present disclosure is applied to dental masks having a rectangular mask body, surgical masks mainly used by medical personnel such as doctors and nurses, and KF-AD masks, which are droplet blocking masks. It should be noted in advance that the term "dental mask" described herein includes not only a dental mask but also a surgical mask and a KF-AD mask.

Additionally, the Korea Ministry of Food and Drug Safety conducts a leakage rate test in performance testing for masks. The leakage rate test is a test that measures the extent of air leakage when the wearer moves around while wearing a mask. Unlike 2D and 3D masks, dental masks are structurally different in that when the mask is worn, both sides of a mask body and an upper part where a nose wire is embedded come off from the cheeks and bridge of the nose of the wearer, leaving gaps. Due to this drawback, dental masks proposed so far have not been able to pass the leakage rate test and therefore have not been approved as health masks. However, the flexible dental mask according to the present disclosure ensures that the both sides of the mask body adhere closely to the wearer's cheeks without coming off and a nose bridge adhesive pad is attached to an inner side of the mask body, thereby completely solving a leakage problem, which is a fatal weakness of the conventional dental masks and realizing a leakage rate that is improved compared to the 2D masks and 3D masks.

A flexible dental mask 10 according to an embodiment of the present disclosure includes a rectangular mask body 11 that covers the wearer's mouth and nose, and a pair of ear bands 13 attached to both sides of the mask body 11, respectively, to prevent the mask body from being separated from the wearer's cheeks when the mask 10 is worn. The mask body 11 is manufactured by inserting a filter between a non-woven outer fabric and an inner fabric and bonding the edges of the rectangular shape. As in the general structure of the dental masks, the mask body 11 has multiple pleated portions 111 folded in two to four stages so that the pleated portions 111 are unfolded and increased in area to conform to the shape of the wearer's cheeks when the mask 10 is worn. The unillustrated reference numeral 12 is a nose wire that is embedded in the center of the upper end of the rectangular shape and is folded to conform to the shape of the bridge of the wearer's nose when the mask 10 is worn. However, the nose wire may not be embedded as needed.

Figure 5:
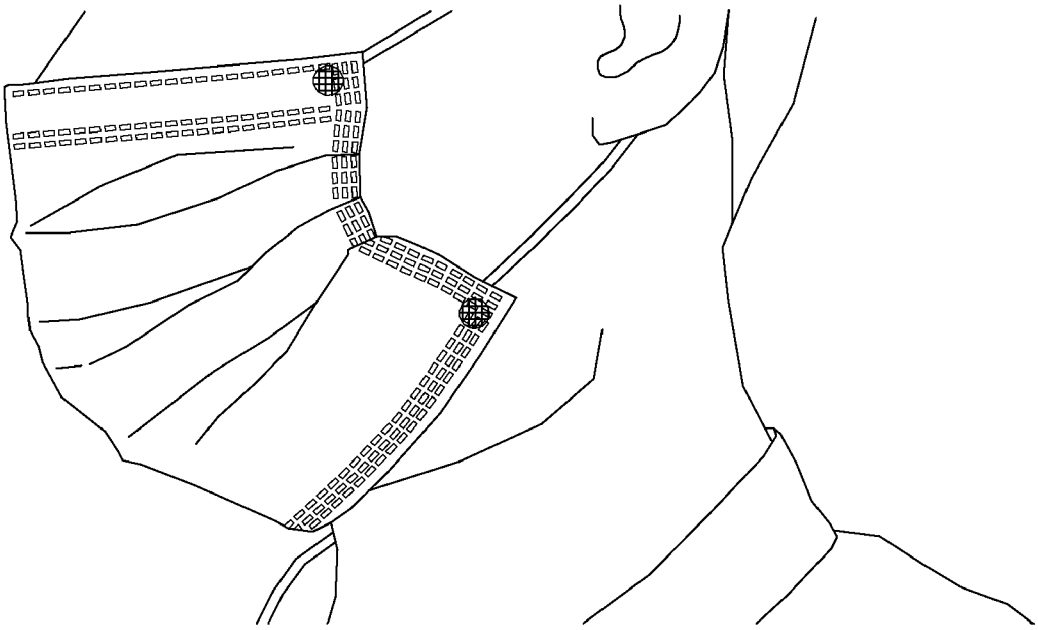
FIG. 5 is an image illustrating a state in which both sides of a mask body are came off from the wearer's cheeks without closely adhering to the cheeks when wearing a general dental mask.

As for the dental masks proposed so far, since the both sides of the mask body are entirely bonded from top to bottom, when the mask is worn, the stiff both sides of the mask body cannot bend into a round shape and eventually come off from the wearer's cheeks without closely adhering to the cheeks. Therefore, even while being worn, the mask may fail to completely block the penetration of various viruses or foreign substances, posing a very serious problem with adhesion and making it impossible for use as a health quarantine mask (see FIG. 5).

However, the adhesion problem of the conventional dental masks described above is completely solved by the present disclosure. That is, according to the flexible dental mask 10 according to the present disclosure, the pleated portions 111 are formed so that there is no non-overlapping area between the pleated portions 111, and the both sides of the mask body 11 are bonded so that a predetermined length of a lower end of each of the pleated portions 111 formed in two to four stages is not bonded, thus forming a non-bonded portion 113, and only the remaining part excluding the non-bonded portion 113 is bonded, thus forming a bonded portion 112 (see FIG. 1).

Figure 4:
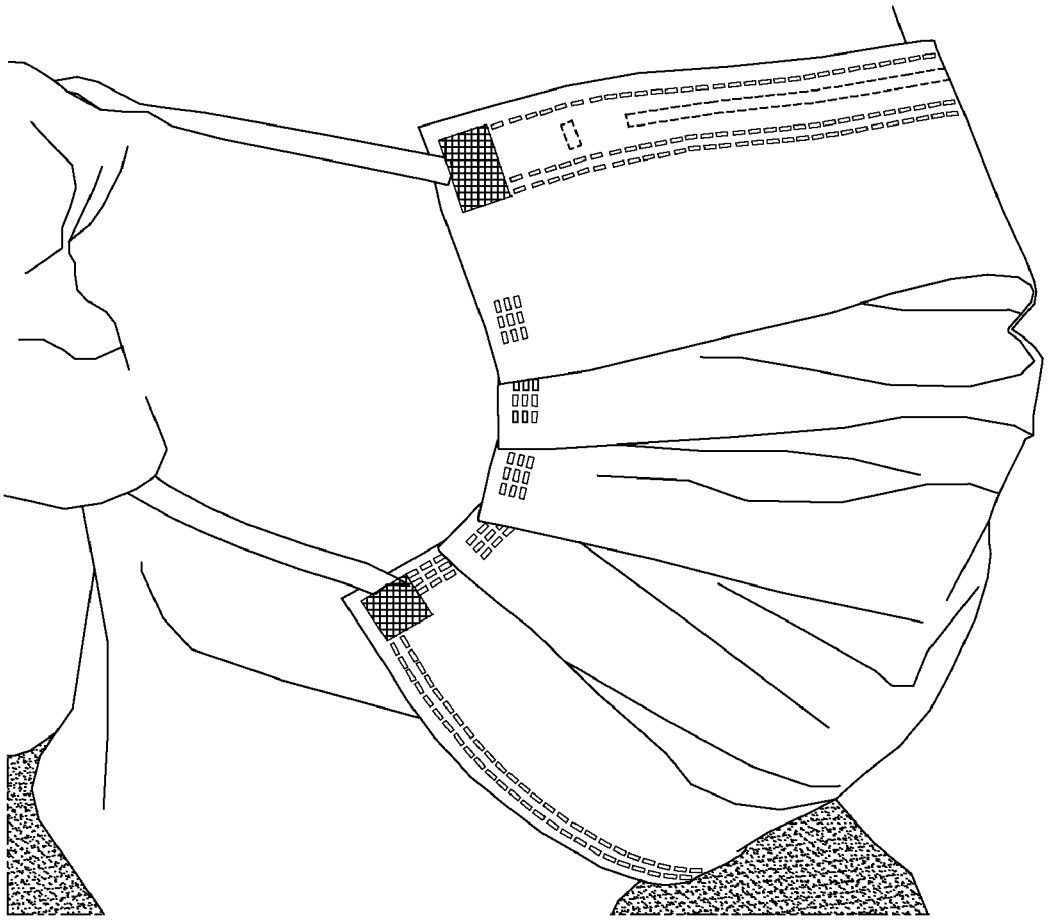
FIG. 4 is an image illustrating a state in which both sides of the mask body are closely adhered to the wearer's cheeks when wearing the flexible dental mask according to the present disclosure.

Generally, when the conventional dental mask is worn, the shape of the both sides of the mask body becomes a round shape. However, the biggest technical feature of the flexible dental mask 10 according to the present disclosure is that the non-bonded portion 113 is defined between bonded portions 112 when bonding the both sides of the mask body 11, so when the mask 10 is worn and the sides of the mask are deformed from a straight shape into a round shape, the non-bonded portion 113 between the bonded portions 112 is folded or overlapped with the bonded portions 112 like a bellows (pleated box) or a folding fan, thereby freely and flexibly coping with shape deformation and enabling the both sides of the mask body 11 to completely closely adhere to the wearer's cheeks (see FIG. 4).

It is preferable that the length of each of the bonded portions 112 bonded to the both sides of the mask body 11 is about two to three times the length of the non-bonded portion 113. When the length of the bonded portion 112 is equal to or greater than three times the length of the non-bonded portion 113, the length of the non-bonded portion 113 becomes too short. Accordingly, the both sides of the mask body may not form a smooth round shape when the mask 10 is worn, resulting in the both sides coming off from the wearer's cheeks without closely adhering to the cheeks. On the other hand, when the length of the bonded portion 112 is equal to or less than two times the length of the non-bonded portion 113, the length of the bonded portion 112 becomes too short while the length of the non-bonded portion 113 becomes too long, so the pleated portions 111 may not be formed properly and the sides of the pleated portions 111 may become open, causing problems in wearing the mask 10.

Figure 2:
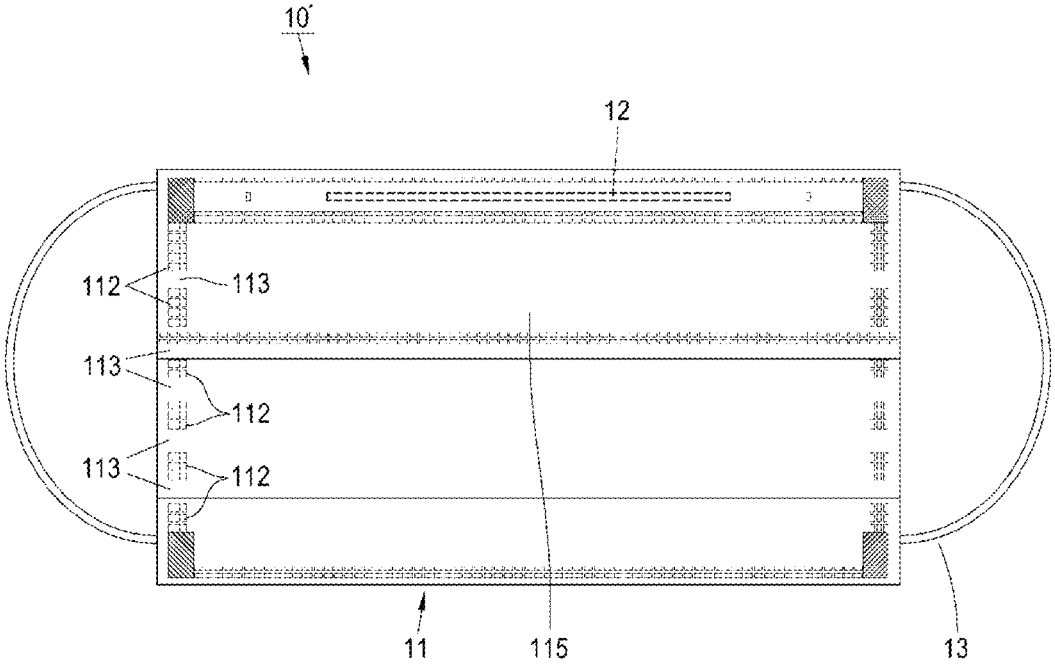
FIG. 2 is a view illustrating a mask back side in an embodiment in which a nose bridge adhesive pad is attached to a rear surface of a flexible dental mask.

As illustrated in FIG. 2, another embodiment of the present disclosure presents a flexible dental mask 10' in which a nose bridge adhesive pad 115 is attached to an upper end of a rear surface of a mask body 11. This embodiment remains the same as the previously described embodiment except that the nose bridge adhesive pad 115 is attached to the rear surface of the mask body 11, and thus identical parts are given the same reference numerals.

Figure 3:
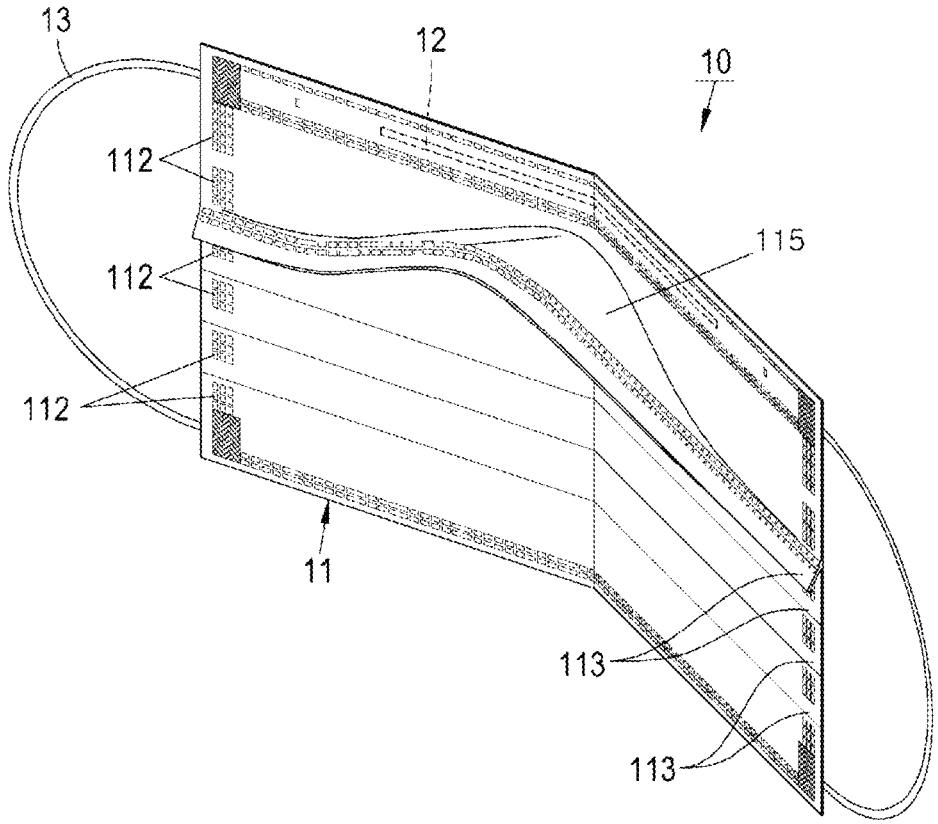
FIG. 3 is a view illustrating the nose bridge adhesive pad in FIG. 2 separated from the mask body.

The nose bridge adhesive pad 115 may be manufactured in a quadrangular shape such as a rectangle or trapezoid with a predetermined width (the "width" refers to the vertical height) or in various shapes that can be held on the bridge of the nose. Since a lower part of the nose bridge adhesive pad 115 is separated from the mask body 11 without being bonded, when the mask 10' is worn and the lower part of the nose bridge adhesive pad 115 is separated from the mask body 11, a space is formed between the nose bridge adhesive pad 115 and the mask body 11. Accordingly, the mask 10' is worn with the nose bridge adhesive pad 115 on the bridge of the nose at the part where the space is formed (see FIG. 3).

Since both sides of the nose bridge adhesive pad 115 are bonded to the mask body 11, the nose bridge adhesive pad 115 is held at the both sides so as not to slip down. Therefore, even when the wearer holds and pulls down the mask body 11 by hand, only the mask body 11 is slightly moved down, and the nose bridge adhesive pad 115 is kept closely adhered to the bridge of the nose, preventing the mask body 11 from slipping down any further.

Since a nose wire is not embedded in the nose bridge adhesive pad 115, the nose bridge adhesive pad 115, which is made of a non-woven filter, etc., flexibly adheres to the bridge of the nose. Therefore, gaps at curved areas around the bridge of the nose are completely blocked, thereby blocking the penetration of viruses through the gaps, and preventing a phenomenon in which glasses fog up due to exhalation of the wearer talking or breathing with the mask 10' on.

It is preferable that the nose bridge adhesive pad 115 has a vertical height that is about ½ to ⅓ of the vertical height of the mask body 11. When the vertical height of the nose bridge adhesion pad 115 is greater than ½ of the vertical height of the mask body 11, it is difficult to properly wear the mask. When the vertical height is small to be equal to or less than ⅓, there is a possibility that the nose bridge adhesive pad 115 may slip off the bridge of the nose when the wearer talks with the mask 10' on, so the mask body 11 may move out of the bridge of the nose and the mask 10' may slip down.

The nose bridge adhesive pad 115 is attached by bonding the upper end and both sides thereof to the mask body 11. It is preferable that the both sides of the nose bridge adhesive pad 115 are not entirely, but partially bonded. In detail, the upper end of each of the both sides of the nose bridge adhesive pad 115 is bonded to the mask body 11, thus forming a bonded portion 112, and the part below the bonded portion 121, that is, a predetermined length of the lower end of each of the both sides of the nose bridge adhesive pad 115, is not bonded to the mask body 11, thus forming a non-bonded portion 113. Of course, the both sides of the nose bridge adhesive pad 115 may be entirely bonded without forming the non-bonded portion 113. Here, "bonding" refers to joining two parts, so sewing is also included in the meaning of the term "bonding"

Since the non-bonded portion 113 that is not bonded to the mask body 11 is formed at the lower end of each of the both sides of the nose bridge adhesive pad 115, it is possible for a people who have a large nose to wear the mask 10' without a problem. It is also possible to easily wear the mask 10' with the nose bridge adhesive pad 115 on the bridge of the nose regardless of the size of the face or the nose. Further, the both sides of the mask body 11 forms a natural round shape without being wrinkled, enabling the sides of the mask to closely adhere to the wearer's cheeks without interference.

The above description is an example of the present disclosure, and the embodiments described herein are for illustrative purposes rather than limiting the spirit of the present disclosure. Therefore, those skilled in the art will appreciate that various modifications, additions, and substitutions are possible, without departing from the scope and spirit of the present disclosure. The scope of the present disclosure should be determined on the basis of the descriptions in the appended claims, and all equivalents thereof should belong to the scope of the present disclosure.

What is claimed is:

1. A flexible face mask having sides configured to adhere closely to a wearer's cheeks, the flexible face mask comprising:

a rectangular mask body having a long side defining a horizontal direction and a short side defining a vertical direction, the mask body including multiple pleated portions folded in two to four stages, wherein the pleated portions are formed so that there is no non-overlapping area between the pleated portions, and both sides of the mask body along the vertical direction are bonded so that a predetermined length of a lower end of each of the pleated portions is not bonded, thus forming a non-bonded portion, and the non-bonded portion is defined between bonded portions, so when the mask is worn and the sides of the mask are deformed from a straight shape into a round shape, the non-bonded portion is inserted between and overlapped with the bonded portions, thereby coping with shape deformation of the sides of the mask and enabling the both sides of the mask body to closely adhere to the wearer's cheeks; and each of the bonded portions bonded to the both sides of the mask body extends in the vertical direction and has a vertical dimension two to three times a vertical dimension of the non-bonded portion.

2. The flexible face mask of claim 1, wherein a nose bridge adhesive pad having a vertical height that is about ½ to ⅓ of a vertical height of the mask body is further attached to an upper end of a rear surface of the mask body.

3. The flexible face mask of claim 2, wherein the nose bridge adhesive pad is attached by bonding an upper end and both sides of the nose bridge adhesive pad to the mask body, and the both sides of the nose bridge adhesive pad are bonded to the mask body so that a predetermined vertical dimension of a lower end of the nose bridge adhesive pad is not bonded, thus forming a non-bonded portion.

* * * * *